US005201376A

United States Patent [19]

Williams

[11] Patent Number: 5,201,376

[45] Date of Patent: Apr. 13, 1993

[54] ROCK BIT WITH IMPROVED GAGE INSERT

[75] Inventor: Mark E. Williams, Grand Prairie, Tex.

[73] Assignee: Dresser Industries, Inc., Dallas, Tex.

[21] Appl. No.: 872,260

[22] Filed: Apr. 22, 1992

[51] Int. Cl.[5] ..... E21B 10/16

[52] U.S. Cl. ..... 175/374; 175/426; 175/431

[58] Field of Search ..... 175/374, 425, 430, 426; 76/108.4

[56] References Cited

U.S. PATENT DOCUMENTS

| | | | |
|---|---|---|---|
| 2,507,221 | 5/1950 | Phipps | 175/420.1 |
| 2,687,875 | 8/1954 | Morlan et al. | 175/374 |
| 2,774,570 | 12/1956 | Cunningham | 175/374 |
| 2,774,571 | 12/1956 | Morlan | 175/341 |
| 2,990,025 | 6/1961 | Talbert et al. | 175/375 |
| 3,389,761 | 6/1968 | Ott | 175/374 |
| 3,442,342 | 5/1969 | McElya et al. | 175/374 |
| 3,696,876 | 10/1972 | Ott | 175/374 |
| 3,800,891 | 4/1974 | White et al. | 175/374 |
| 4,056,153 | 11/1977 | Miglierini | 175/374 X |
| 4,058,177 | 11/1977 | Langford et al. | 175/374 |
| 4,679,640 | 7/1987 | Crawford | 175/374 |
| 4,832,139 | 5/1989 | Minikus et al. | 175/374 |
| 4,838,366 | 6/1989 | Jones | 175/426 |
| 5,152,353 | 10/1992 | Denton et al. | 175/374 X |

FOREIGN PATENT DOCUMENTS 211516 3/1967 Sweden .

OTHER PUBLICATIONS

RockBit International Inc. Leaflet, "The Ultimate Weapon in Gage Warfare", World Oil, Jul. 1991.

Smith International Advertisement, "Introducing Smith Tool's New Steerable-Motor Bits", World Oil, May, 1991.

*Primary Examiner*—Stephen J. Novosad

[57] ABSTRACT

A roller cutter rock bit includes a cutter constructed with a relief adjacent the cutter heel and gage inserts which each include elongated gage and bottom hole cutting edges which are separated from each other by an obtuse included angle. The edges serve to cut both the bottom of the borehole and the wall when changing the direction of drilling. Both the gage cutting edge and the bottom cutting edge of each gage insert are shaped so as to aggressively cut formation material.

9 Claims, 3 Drawing Sheets

ROCK BIT WITH IMPROVED GAGE INSERT

BACKGROUND OF THE INVENTION

1. Technical Field

This invention relates generally to a roller cone rock bit and, more particularly, to the structure of the gage inserts and rotatable cones of such a bit.

2. Background Information

One form of drill bit used in drilling a borehole in the surface of the earth is a roller cutter bit. In one type of roller cutter bit, the cutters each have a cone shaped body with a plurality of hard material cutting elements or inserts protruding from the surface of the body. As the bit is rotated under weight against the earth, the inserts penetrate rock in a gouging scraping action to chip away formation material and form a borehole.

In drilling a borehole, it is important that the drilled diameter of the hole or gage be maintained throughout the service life of the drill bit. One reason for this is simply that the borehole must be large enough to accommodate the next bit when the first one is replaced. If the hole is too small, the replacement bit may become unnecessarily worn before reaching the bottom of the hole. In a typical roller cone bit, two different types of inserts are used to cut and maintain the borehole wall at the gage diameter. In the art, one of these inserts is called the gage insert. On a roller cone body, a row of gage inserts, the gage row, is located at the base or heel of the cone so that when the cone is rotated, bottom hole cutting edges on the gage inserts cut the bottom of the borehole to the desired gage diameter. A second surface on the gage inserts acts against the borehole wall to maintain the gage diameter.

A roller cone bit having inserts of the forgoing type is disclosed in U.S. Pat. No. 2,774,570. Therein, inserts characterized as heel series inserts have a rounded or ovoid surface contour and are positioned on the body of the cone to bisect the angle formed by the two portions of the cone which act to cut the bottom and form the wall of the borehole. Thus, these heel series inserts act with rounded surfaces on both the bottom and wall of the borehole. Cooperating with the heel series inserts are inserts mounted in the gage cutting portion or gage wall of the cone body. These latter inserts, termed gage inserts in Pat. No. 2,774,570, are described as being rounded or ovoid in shape and forming a slight protrusion beyond the gage surface of the cone for disintegrating formation at the borehole wall and maintaining gage.

In an earlier patented form of roller cone bit, the use of separate inserts in the gage wall of the cone body was avoided. U.S. Pat. No. 2,687,875 discloses the orientation of a cylindrical insert having an ovoid or rounded cutting end in either of three different positions relative to the gage wall at its juncture with the bottom hole cutting portion of the roller cone body. In one position (FIG. 3), the insert bisects the angle between the two portions of the cone. In another orientation (FIG. 5), the ovoid end of the insert is disposed to act on the wall of the hole with a side surface of the insert positioned to contact and disintegrate the bottom of the borehole. In the third position (FIG. 4), the side of the insert extends parallel to the borehole wall and may be flattened to present a greater surface to effect disintegrating action at gage.

To improve the wearability of gage inserts in U.S. Pat. No. 4,058,177, an asymmetric gage row insert is disclosed as providing a larger amount of wall contacting surface. This larger surface acts to decrease the wear on the gage insert and increases the ability of the bit to maintain gage. Specifically, the asymmetric insert has a cylindrical base integrally joined with an asymmetrical head and telescoped into a socket in the body of the cone. The head projects from the surface of the cone body and includes a gage cutting surface which is the largest plane surface of the head. With respect to the surface of the cone body, this plane surface is angled to contact the borehole wall at substantially the gage angle of the bit when drilling. Thus, the gage cutting surface presents a relatively large flat surface for wearing against the borehole wall and maintaining the gage diameter.

While the roller cone bits of the foregoing type have resulted in improved maintenance of gage, changes in drilling techniques which require that the direction of drilling be changed while drilling have resulted in the need for roller cone drill bits which are easier to steer.

SUMMARY OF THE INVENTION

The primary aim of the present invention is to enhance the steerability of a roller cone bit such as when changing the direction of drilling but to do so without loss in the ability of the bit to effectively maintain the gage diameter of the borehole. This is achieved in the present invention by virtue of the provision of gage inserts of a novel configuration which act in cooperation with uniquely shape heels on the cones when changing direction to cut aggressively into both the borehole wall and the bottom of the borehole.

Invention also resides in the structure of the roller cones of the bit to include the combination of two elongated cutting edges angularly disposed relative to each other on the inserts for simultaneously cutting both the bottom and the wall of the borehole. Still further, invention resides in the cooperation between the wall cutting edges of the gage inserts and a novel relief area in the heel of the cone enabling the drilling angle of the bit to be changed without any gage surface in the heel area of bit abutting the borehole wall and resisting the angular change in the drilling direction of the bit.

The foregoing and other advantages of the present invention will become more apparent from the following description of the preferred embodiment when taken in conjunction with the accompanying drawings.

BEST MODE FOR CARRYING OUT THE INVENTION

As shown in FIGS. 3 through 7 for purposes of illustration, the present invention is embodied in a rotary rock bit 10 including a bit body (not shown) adapted to be connected at its pinned end to the lower end of a rotary drill string. The bit body includes a passage providing communication for drilling muds or the like passing downwardly through the drill string to allow the drilling mud to be directed to the bottom of the borehole and pass upwardly in the annulus between the wall 25 of the borehole 19 and drill pipe carrying cuttings and drilling debris therewith to the surface.

Figure 3:
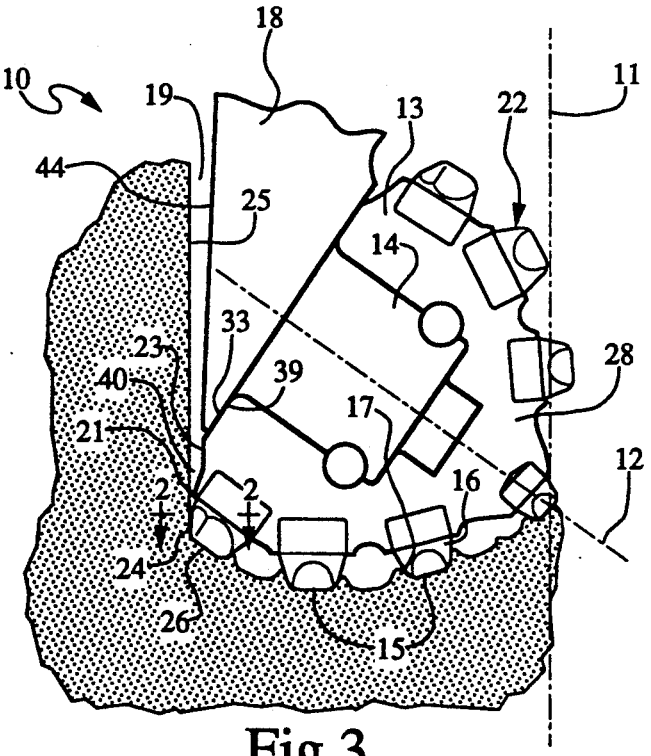
FIG. 3 is a schematic fragmentary view similar to FIG. 1 but showing a roller cone bit embodying the novel features of the present invention.

Included within the body of the bit 10 are three substantially identical arms 18 and a portion of one such arm is shown in FIG. 3. The lower portion of the arm is provided with a conventional bearing pin or shaft 14 upon which a generally conical cutter 22 is rotatably supported. The cutter rotates about an axis 12 which is tilted downwardly and inwardly at an angle toward a rotational axis 11 of the bit. For purposes of orientation, the rotational axis of the bit illustrated in FIG. 3 extends generally parallel to the borehole wall 25.

More specifically, the cutter 22 includes a nose portion 28 that is oriented toward the bit axis 11 of rotation and a truncated base portion or heel 21 having an outer edge positioned at the intersection between the wall 25 and the bottom 26 of the borehole 19. The cutting action of the base defines the diameter for gage of the borehole. For cutting the bottom of the borehole, a plurality of inserts 15 protrude outwardly from the surface 16 of the cutter forming a cutting profile such as is illustrated in FIG. 3. A similar profile is shown in the prior art cutter 122 illustrated in FIGS. 1 and 2.

Figure 1:
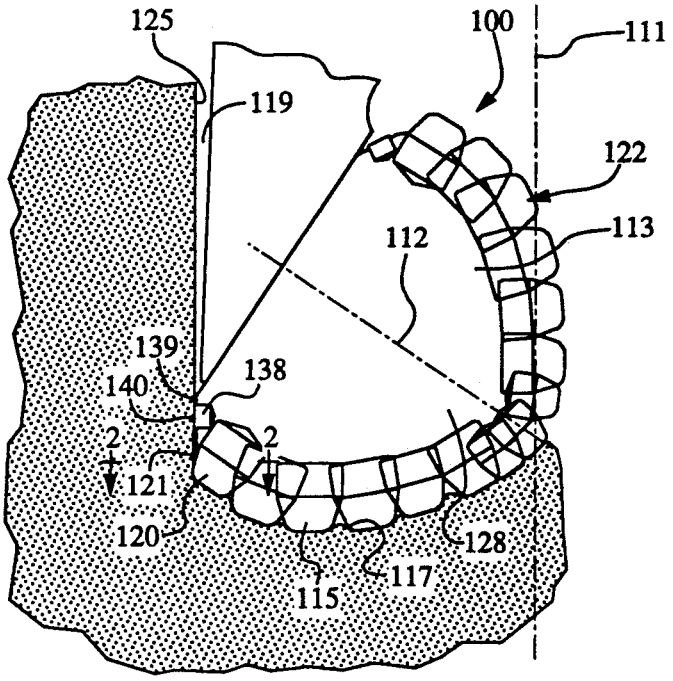
Fig.1 (PRIOR ART)
FIG. 1 is a schematic fragmentary view of a prior art roller cone bit showing the bit inserts in rotated profile relative to a portion of a borehole.
Figure 2:
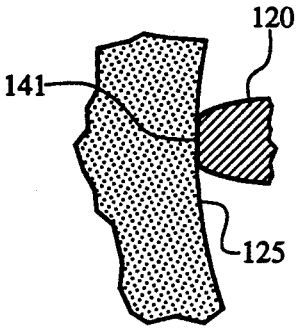
Fig.2 (PRIOR ART)
FIG. 2 is an enlarged fragmentary view of the prior art insert taken substantially along line 2—2 of FIG. 1.
Figure 4:
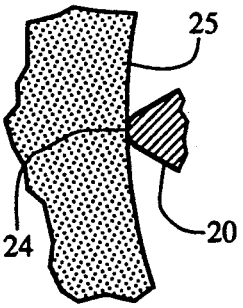
FIG. 4 is an enlarged fragmentary view taken substantially along line 4—4 of FIG. 3.

As shown in the prior art FIGS. 1 and 2, inserts 120 at the heel 121 are used to cut the borehole gage. Herein, this row of inserts 120 for cutting gage is referred to as the gage row inserts and these inserts are subjected to the most rigorous drilling action. In the illustrated prior art bit 100, additional inserts 138 herein termed surf inserts are mounted within the body of the cutter and are mounted generally flush with or protrude only slightly from a gage surface 139. The latter is that surface which is of a generally frustoconical shape extending from the cutter body 113 in an opposite direction from the nose 128 away from the bottom 117 of the borehole. The angle of the gage surface relative to the cone axis 112 is such that as the cone is rotated, at the gage diameter of the bit, the gage surface 139 extends generally parallel to the rotational axis 111 of the bit.

In acting on the borehole wall 125, generally flat surfaces 140 of the surf inserts 138 help maintain the gage diameter of the borehole 119 with a flat surface wearing action rather than with the gouging and crushing action that occurs as the inserts 115 disintegrate the bottom of the borehole. Similarly, as is shown in FIG. 2, a large area gage surface 141 on the gage inserts 120 wears on the borehole wall 125. Thus, in the prior art bit 100 both the surf inserts 138 and the gage inserts 120 are designed to avoid the loss of gage diameter throughout the wear life of the bit.

In accordance with the primary aim of the present invention, steerability of the rock bit 10 (see FIG. 3) is enhanced without a loss in effectively maintaining borehole gage. For this purpose, the heel 21 of the roller cone body 13 is constructed with a unique relief 23 and the gage inserts 20 each include elongated crests or cutting edges 26 and 24 separated by an obtuse included angle 37 (also see FIG. 8). The edges serve to cut both the bottom 17 of the borehole 19 and the wall 25, respectively. Advantageously, when changing the direction of drilling, the wall cutting edge 24 is shaped so as to aggressively cut into wall and the relief 23 keeps the heel 21 of the cone from engaging the wall 25 and interfering with the change in direction.

In the present instance, the relief 23 is formed in the cone body 13 between the heel 21 and a shoulder 39 (see FIG. 3) formed on arm 18 around the base of the bearing pin 14. As a result, a relatively large gap 40 is left between the wall 25 of the borehole and the heel of the cone. Specifically, the relief is defined by an annular wall 41 (see FIG. 5) which is generally frustoconical in the shape extending radially inward relative to the axis 12 (not shown in FIG. 5) of the cone body 13 upon progressing toward the drill bit arm 18 from the heel 21. The angle at which the annular wall 41 is formed relative to the axis of the cone body is greater than the angle which gage makes relative to the same axis. Thus, the annular wall 41 progresses relatively sharply away from the wall of the bore. At a position spaced radially inward from the borehole wall, the annular relief wall 41 intersects a second frustoconical wall 43. The latter intersects with an annular base wall 33 and extends located generally in alignment with an outer surface 44 of the arm 18. With the two frustoconical walls 41 and 43, defining the relief, the gap 40 exists as an annular space between the outside of the arm and the borehole wall 25 allowing the drilling direction of the bit to be changed without the cone surface between the heel 21 and the shoulder 39 interfering with the change in drilling direction by engagement with the borehole wall.

Figure 5:
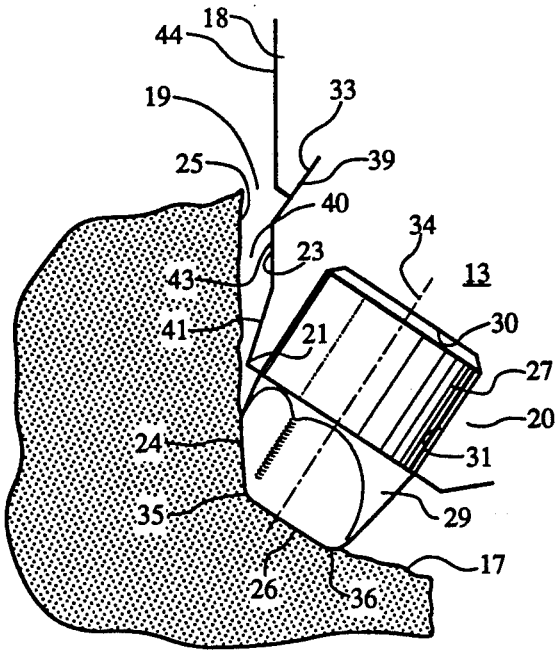
FIG. 5 is a fragmentary view of a portion of the roller cone bit shown in FIG. 3 enlarged for purposes of clarity of illustration.
Figure 6:
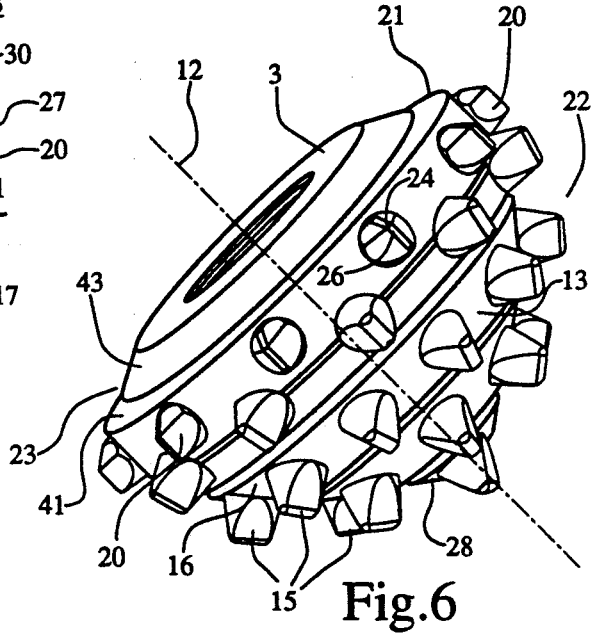
FIG. 6 is an isometric view of a roller cone cutter embodying the novel features of the present invention.
Figure 7:
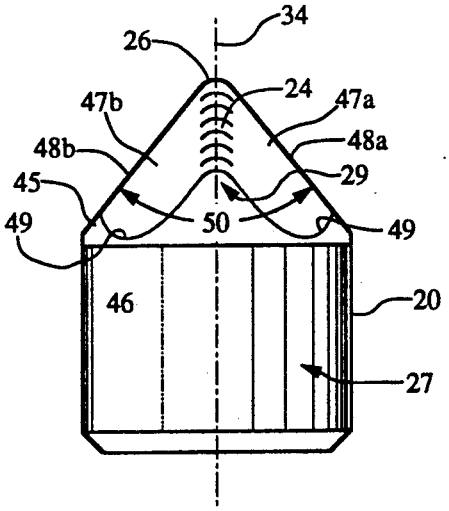
FIG. 7 is a front elevational view of one form of a novel gage insert suitable for use in the present invention.
Figure 11:
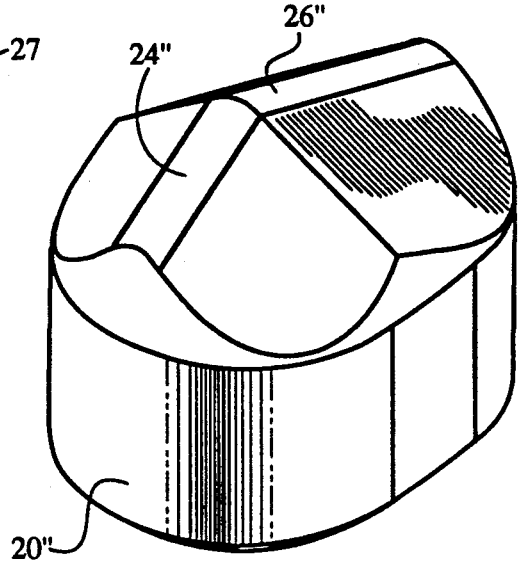
FIGS. 10 and 11 are enlarged perspective views of two alternative forms of novel gage inserts suitable for use in the present invention.
Figure 10:
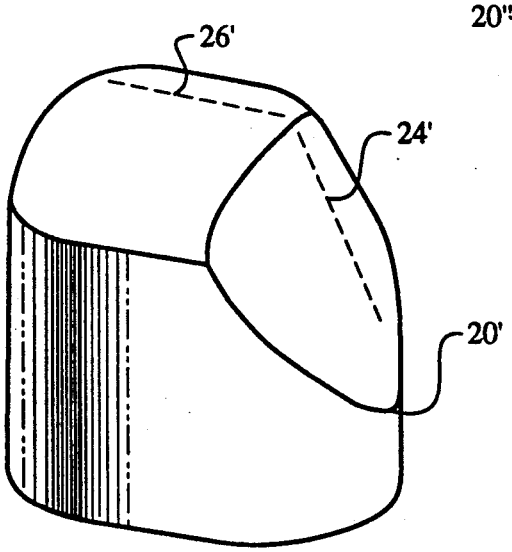

For aggressively cutting into the borehole wall 25, each of the gage inserts 20 is of a particularly unique shape including a truncated conically shaped extension 29 integrally formed with a cylindrical base 27. More particularly, as shown in FIG. 5, the base 27 is connected to the body 13 of the cutter 22 by a press fit into a correspondingly shaped socket 30. Preferably, but not necessarily, the base of the insert is of a generally cylindrical shape, meaning that it may be truly cylindrical in the shape or of a similar shape having an oblong or oval-sectional configuration. Alternate forms of inserts are shown in FIGS. 10 and 11 wherein parts corresponding to those of the cylindrical base insert 20 are identified by primed and double primed reference numbers.

More specifically, with respect to the insert 20 the conically shaped extension 29 herein is defined by an apex angle of approximately forty degrees (40°) with a true cone surface 45 intersecting the generally cylindrical base at a ridge 46. For softer formations, the extension may be longer so that the apex angle is less. Similarly, for harder formations, the extension of the inserts needs to be less so that the apex angle is correspondingly greater. When the gage insert 20 is mounted in the socket 30 in the cone body 13, the ridge 46 substantially coincides with the edge of the socket. Protruding outwardly from the ridge, the surface of the extension 29 is comprised of the true cone surface 45 and two sets of truncating surfaces 47 and 48 forming the bottom hole and gage wall cutting edges 26 and 24, respectively. Specifically, the gage cutting edge 24 is defined by the rounded intersection of the first set 47 of planar flanking surfaces 47*a* and 47*b*. As shown generally in FIGS. 5 and 8, the latter intersection is such that the gage cutting edge 24 is a tooth-like cutting edge elongated in an axial direction relative to the borehole. The length of the gage cutting edge is dictated by the intersection of the edge with the conical outer surface 45 of the extension 29. Moreover, the angle of intersection of the planar flanking surfaces 47*a* and 47*b* is preferably chosen such that these plane surfaces intersect the conical surface 45 of the extension at a closest point, such as is indicated by the reference number 49 in FIG. 7, to the ridge 46 of not less than around 0.020".

The specific angle which the gage cutting edge 24 makes with respect to the axis 34 of the insert 20 depends upon the orientation of the axis 34 of the insert relative to the rotational axis 12 of the cutter 22 and, in turn, the relative orientation of the cutter rotating axis 12 relative to the rotational axis 11 of the bit. Whatever these relationships are for a particular bit design, the orientation of the elongated gage cutting edge should be generally parallel to the borehole wall 25. However, the edge may be rotated relative to vertical with a plane parallel to the wall.

Figure 8:
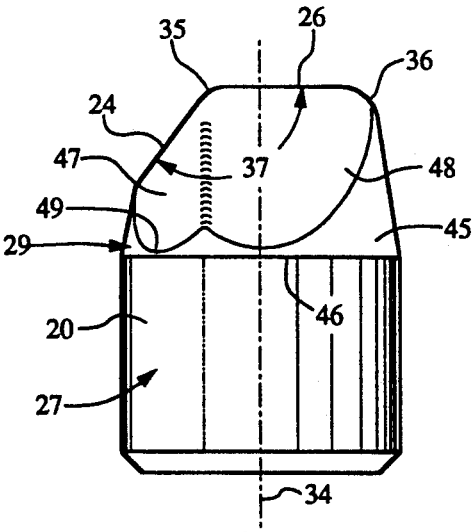
FIG. 8 is a side elevational view of the novel insert shown in FIG. 6.
Figure 9:
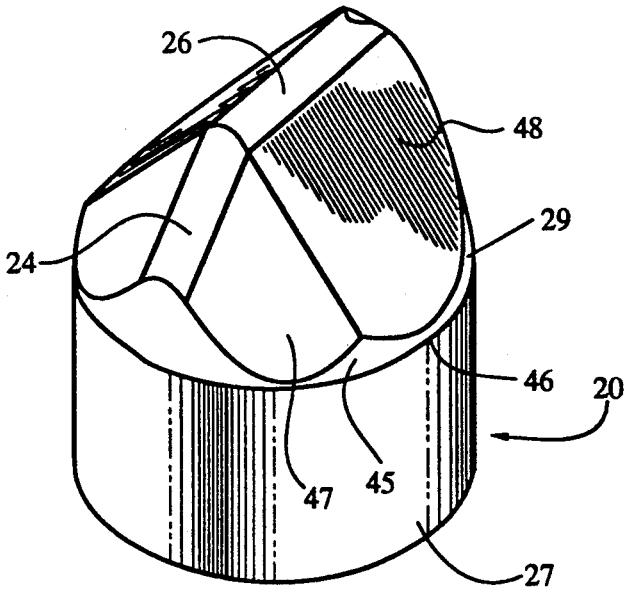
FIG. 9 is an enlarged isometric view of the primary exemplary form of novel gage insert suitable for use in the present invention.

Like the gage edge 24, the bottom hole cutting edge 26 is formed by the rounded intersection of the planar flanking surfaces 48*a* and 48*b*. As shown in edge in FIG. 7, these latter two flanking surfaces intersect at an acute angle 50 and are disposed symmetrically with respect to the axis 34 of the insert. As shown in FIG. 8, the bottom hole cutting edge 26 extends generally perpendicular (i.e. plus or minus about thirty degrees, 30°) to the axis 34. Also, the intersection of the planar flanking surfaces 48*a* and 48*b* with the outer conical surface 45 is preferably chosen so as to be spaced not less than 0.020" from the ridge 46.

In view of the foregoing, it will be seen that the present invention brings to the art a new and improved roller cone bit 10 with enhanced steerability for changing the direction of drilling without loss in the ability of the bit to effectively maintain the gage diameter of the borehole. Advantageously, this is accomplished by reason of the provision of the novel gage inserts 20 which act in cooperation with the uniquely shaped relief surface 23 adjacent the heel of the cutter 22 when changing direction for the elongated cutting edges 24 and 26 gage inserts to cut aggressively into both the wall 25 and the bottom 17 of the borehole. Thus, the drilling angle of the bit may be changed without any gage surface in the heel area of bit abutting the borehole wall and resisting the angular change in the drilling direction of the bit.

I claim:

1. In a roller cone drill bit having a predetermined radial gage dimension relative to a central axis of said bit and wherein each cone comprises a body rotatably mounted on a shaft and having a plurality of cutting inserts connected to said body and protruding from the surface thereof for cutting engagement with the bottom of a borehole and including a row of gage inserts mounted therein adjacent the heel of the cone body, the improvement comprising a relief surface formed in said body at the heel thereof and spaced radially away from the gage dimension of said bit and toward the central axis of said bit, each of said gage inserts further including an elongated gage cutting edge for cutting the wall of said borehole to gage and extending generally parallel to the axis of said bit when cutting said borehole wall, and an elongated bottom hole cutting edge formed thereon and disposed at an obtuse angle relative to said gage cutting edge for cutting a portion of the bottom of the hole adjacent the wall thereof.

2. In a roller cone drill bit having a predetermined radial gage dimension relative to a central axis of said bit and wherein each cone comprises a body rotatably mounted on a shaft and having a plurality of cutting inserts connected to said body and protruding from the surface thereof for cutting engagement with the bottom of a borehole and including a gage row of cutting inserts mounted therein adjacent the heel of the cone body, the improvement comprising a relief surface formed in said body at the heel thereof and spaced radially away from the gage dimension of said bit and toward the central axis of said bit, each of said gage row inserts being tooth-shaped inserts and each of said gage row tooth-shaped inserts including an elongated tooth-shaped cutting edge for cutting the wall of said borehole to gage and extending generally parallel to the axis of said bit when cutting said borehole wall, and an elongated tooth-shaped bottom hole cutting edge formed thereon and disposed at an obtuse angle relative to said gage cutting edge for cutting a portion of the bottom of the hole adjacent the wall thereof.

3. A roller cone drill bit comprising in combination
- a bit body having at least one arm connected thereto and depending from said body,
- a bearing pin attached to said arm, and
- a rolling cutter attached to said pin and rotatable on said pin for forming a borehole in the earth of a predetermined radial gage dimension relative to a central axis of said bit, said cutter including
  - a generally conical body having
  - a heel portion disposed on said pin adjacent said arm,
  - a plurality of bottom cutting inserts mounted in said conical body and protruding from the surface thereof for cutting engagement with the bottom of the borehole,
  - a plurality of gage row inserts mounted in said conical body adjacent said heel and protruding from said cone body for cutting both the bottom of the borehole and the borehole wall, each of said gage row inserts having
    - a base mounted within said cutter body,
    - an extension protruding from the face of said cone,
    - a gage wall crest formed in said extension, and
    - a bottom hole crest formed in said extension,
  - a plurality of sockets formed in said cone body one for each of said inserts and each of said sockets having a continuous annular wall receiving said insert base with a press fit, and
  - a relief surface formed in said heel portion and spaced radially inwardly away from the gage dimension of said bit and toward the central axis of said bit.

4. A roller cone drill bit comprising in combination, a bit body having at least one arm connected thereto and depending from said body, a bearing pin attached to said arm, a rolling cutter attached to said pin and rotatable on said pin for forming a borehole in the earth of a predetermined radial gage dimension relative to a central axis of said bit, said cutter including a generally conical body having a heel portion disposed on said pin adjacent said arm, a plurality of bottom cutting inserts mounted in said conical body protruding from the surface of said cone for cutting engagement with the bottom of the borehole, a plurality of gage row tooth-shaped inserts mounted in said conical body adjacent the base thereof and protruding therefrom for cutting both the bottom of the borehole and the borehole wall, each of said gage row inserts having a base mounted within said cutter body, an extension protruding from the face of said cone, a gage wall crest formed in said extension, and a bottom hole crest formed in said extension, a plurality of sockets formed in said cone body one for each of said inserts and each of said sockets having a continuous annular wall receiving said insert base, and a relief surface formed in said heel portion and spaced radially inwardly away from the gage dimension of said bit and toward the central axis of said bit.

5. A tooth-shaped insert for use in the gage row of a roller cutter of a roller cone bit, said insert having a base of a generally cylindrical shape adapted to be mounted on the roller cutter within a socket formed in the body of the cone, an extension integrally formed with said base along a longitudinal axis, a bottom hole tooth-shaped cutting edge integrally formed with said extension opposite said base, said bottom hole cutting edge having opposite ends and extending lengthwise generally linearly therebetween generally perpendicular relative to said longitudinal axis, and a tooth-shaped borehole wall cutting edge integrally formed with and extending lengthwise linearly away from one of said ends of said bottom hole cutting edge at a predetermined obtuse included angle relative to said bottom hole cutting edge for cutting the borehole wall to gage when utilized in the gage row of said roller cutter.

6. An insert for use in the gage row of a roller cutter of a roller cone bit, said insert having a base adapted to be secured to the roller cutter, an extension integrally formed with said base and protruding therefrom along a longitudinal axis, a bottom hole cutting edge integrally formed with said extension opposite said base, said bottom hole cutting edge having opposite ends and extending lengthwise generally linearly therebetween and generally perpendicular relative to said longitudinal axis for broadwise cutting of formation material from the bottom of a borehole, and a borehole wall cutting edge integrally formed with and extending lengthwise linearly away from one of said ends of said bottom hole cutting edge at a predetermined obtuse included angle relative to said bottom hole cutting edge for broadwise cutting the borehole wall to gage when utilized in the gage row of said roller cutter.

7. An insert as defined by claim 6 wherein at least one of said cutting edges is of a tooth-shaped cross-sectional configuration.

8. An insert as defined by claim 6 wherein at least one of said cutting edges is of a rounded cross-sectional configuration.

9. A rolling cutter for use in a roller cone bit for cutting a borehole of a predetermined gage dimension, said cutter including a generally conical body, a plurality of insert sockets integrally formed with said body, each of said sockets having a continuous annular wall, a like plurality of cutting inserts, one insert each being secured to said body within each of said sockets, a heel portion of said cone, a gage row of said inserts on said body adjacent said heel, said inserts in said gage row each having a longitudinal axis extending generally perpendicular to said body and an elongated bottom hole cutting edge formed thereon and extending lengthwise generally perpendicular to said longitudinal axis, said bottom hole cutting edge having opposite ends and extending lengthwise generally linearly therebetween for broadwise cutting a portion of the bottom of the borehole adjacent the wall thereof, and a borehole wall cutting edge integrally formed with and extending lengthwise linearly away from one of said ends of said bottom hole cutting edge at a predetermined obtuse included angle relative to said bottom hole cutting edge for broadwise cutting the borehole wall to gage, and a relief surface formed in said heel and spaced radially away from the gage dimension of said bit.

* * * * *